US009394650B2

(12) United States Patent
Diamond

(10) Patent No.: US 9,394,650 B2
(45) Date of Patent: Jul. 19, 2016

(54) ASPHALT PAVING SEAM GASKET

(71) Applicant: Richard Diamond, Far Hills, NJ (US)

(72) Inventor: Richard Diamond, Far Hills, NJ (US)

( * ) Notice: Subject to any disclaimer, the term of this patent is extended or adjusted under 35 U.S.C. 154(b) by 0 days.

(21) Appl. No.: 14/686,442

(22) Filed: Apr. 14, 2015

(65) Prior Publication Data

US 2015/0337500 A1 Nov. 26, 2015

Related U.S. Application Data

(60) Provisional application No. 62/000,889, filed on May 20, 2014.

(51) Int. Cl.

| | |
|---|---|
| ***E01C 11/00*** | (2006.01) |
| ***E01C 11/02*** | (2006.01) |
| ***E01C 11/06*** | (2006.01) |
| ***E01C 11/12*** | (2006.01) |

(52) U.S. Cl.
CPC ..... *E01C 11/02* (2013.01); *E01C 11/06* (2013.01); *E01C 11/12* (2013.01)

(58) Field of Classification Search
CPC ..... E01C 11/02; E01C 11/06; E01C 11/12
USPC ..... 404/7, 8, 72–79, 83, 84.05, 85, 86, 404/89–95, 101, 105, 107–111, 117, 118; 52/582.1–582.5
See application file for complete search history.

(56) References Cited

U.S. PATENT DOCUMENTS

| | | | | |
|---|---|---|---|---|
| 4,067,155 | A | 1/1978 | Ruff et al. | |
| 4,863,307 | A * | 9/1989 | Jones | E01C 11/221 404/7 |
| 5,489,165 | A * | 2/1996 | Smith | E04H 4/0043 4/403 |
| 5,981,061 | A | 11/1999 | Hegemann | |
| 6,030,144 | A * | 2/2000 | Cannella | A01G 1/08 404/7 |
| 6,099,201 | A * | 8/2000 | Abbrancati | A01G 1/08 404/4 |
| 6,230,451 | B1 * | 5/2001 | Stoller | A63C 19/10 220/9.4 |
| 6,379,078 | B1 * | 4/2002 | Zwier | E01C 11/221 404/4 |
| 6,409,421 | B1 * | 6/2002 | Jones | E01C 11/221 404/7 |
| 6,568,126 | B2 * | 5/2003 | Womack | E02B 3/00 47/33 |
| 6,834,471 | B2 * | 12/2004 | Takagi | E04G 17/14 248/351 |
| 7,097,147 | B2 * | 8/2006 | Shaw | E04G 13/00 248/201 |
| 7,357,594 | B2 | 4/2008 | Takamura | |
| 7,700,672 | B2 | 4/2010 | Partanen | |
| 7,967,524 | B2 * | 6/2011 | Jones | E01C 11/221 404/7 |
| 8,439,597 | B2 | 5/2013 | Diamond | |
| 8,656,655 | B2 * | 2/2014 | Thiessen | B65D 90/24 4/506 |
| 2010/0021233 | A1 | 1/2010 | Chandler | |
| 2010/0316875 | A1 | 12/2010 | Lamon | |

* cited by examiner

*Primary Examiner* — Raymond W Addie
(74) *Attorney, Agent, or Firm* — Thomas J. Germinario

(57) ABSTRACT

An asphalt paving seam gasket comprises a footing sheet, a seam wall and a ramp extension. Once the footing sheet is anchored to the substrate, the seam wall provides a supporting buttress for the compaction of an initial lane of paving, while the ramp extension provides a sloped access for vehicles to mount the initial lane during the interval before the adjoining lane of paving is applied. Optionally, an adhesive resin is applied to the contact surfaces of the gasket to strengthen their bonding to the asphalt material and prevent moisture penetration between the gasket and the asphalt material.

7 Claims, 1 Drawing Sheet

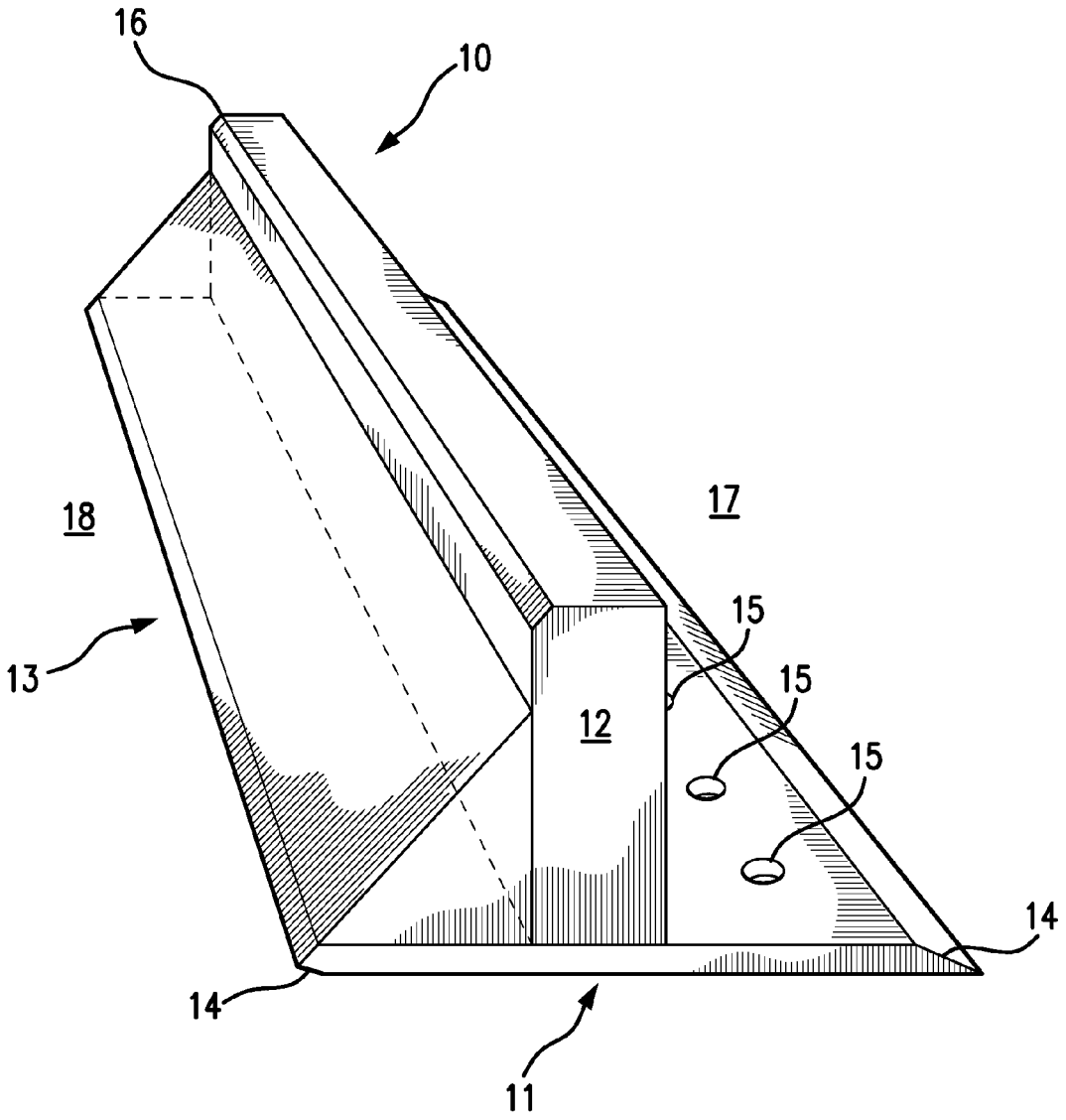
16
10
18
17
13
15
15
12
15
14
14
11

ASPHALT PAVING SEAM GASKET

REFERENCE TO RELATED APPLICATION

The present invention is related to that disclosed in this inventor's U.S. patent application Ser. No. 13/200,928, filed Oct. 5, 2011, which issued on May 14, 2013 as U.S. Pat. No. 8,439,597, the disclosure of which is incorporated herein by reference.

FIELD OF INVENTION

The present invention relates to the field of compositions and methods used in connection with the application, maintenance and repair of asphalt paving. More particularly, the present invention relates to methods and materials used in sealing seams in asphalt paving.

BACKGROUND OF THE INVENTION

One of the major problems that arises in applying the top course paving of a roadway is the sealing of the joint or "seam" between pavement sections or "lanes". Since pavement sections are applied in widths determined by the width of the paver, they are typically applied in multiple passes of the paver, with each pass loosely referred to as a "lane". This means that there is time interval between paving one lane (referred to as the "cold joint lane") and the next adjacent lane (referred to as the "hot joint lane"), during which time the asphalt of the preceding lane has cooled to ambient temperature. The temperature difference between the cooled pavement of the preceding lane and the fresh asphalt of the next adjacent lane makes for a weak bond between the two sections along the seam. This weakness often leads to cracking in the seam area, which allows water to penetrate into the seam and, with freezing and thawing, produces progressive deterioration and separation of the pavement sections.

Another problem that arises in the formation of seams between asphalt lanes relates to differential compaction. When an initial section of asphalt is laid, the seam end necessarily gets less compaction than the central section, because there is no vertical support on the seam end to restrain the asphalt against a compaction force. Reduced compaction in the seam area results in more voids in the asphalt, which weakens the seam and leaves it more vulnerable to moisture penetration and hence deterioration in freeze/thaw cycles.

Even when a strong bond is initially achieved in the seam between lanes, the expansion and contraction of the adjacent lanes under varying weather conditions will subject the seam to stresses and shear forces that will tend to degrade the joint over time and cause it to fail, due to the limited elasticity and tensile strength of asphalt paving materials. In effect, since it is not possible to fuse together the cold joint lane asphalt material to the hot joint lane asphalt material to create a structurally solid bond, the paving seam has to function as an "expansion joint" between adjacent lanes, since the asphalt mix typically applied in the seam area does not have the right mechanical properties to serve this function.

SUMMARY OF THE INVENTION

The present invention comprises a gasket that is laid down prior to the paving of an initial section or lane of a roadway. The gasket comprises a footing sheet, a seam wall and a ramp extension, which together constitute an integral whole.

The footing sheet is a substantially flat, horizontal sheet, having a typical thickness of ½" to ¾". The footing sheet underlies the seam wall and the ramp extension and typically extends 8" to 12" beyond the seam wall on the side of the gasket facing the "cold joint" of the initially paved lane. The footing typically extends 3"-4" beyond the seam wall on the side of the gasket facing the yet-to-be-paved "hot joint." On the cold joint side of the footing sheet are anchoring means for securing the footing to the substrate, which can be sockets or apertures for screws or nails. The edges of the footing sheet on either side are beveled to provide a sloped transition for the underside of the asphalt layer. And applied to the gasket walls and footing sheet surface is a flexible epoxy mix to prevent water penetration between the gasket and the asphalt material.

The seam wall has the shape of a right-rectangular prism with typical dimensions 2" high by 1" wide. The height of the seam wall is selected to match the thickness of the asphalt layer to be applied. The top edge of the seam wall facing the hot joint side of the gasket is beveled to provide a sloped transition for the surface of the asphalt layer.

Abutting the seam wall on the hot joint side of the gasket is the ramp extension, which has the shape of a right-triangular prism, with typical dimensions 1" high by 3"-4" wide, it's height being approximately ½ that of the seam wall and its base being coextensive with the hot joint side of the footing.

Before the paving of the initial lane forming the cold joint side of the seam, the gasket is installed and secured to the substrate by the anchoring means on the cold joint side of the footing. The asphalt layer is then applied with a typical increment of ½" above the top of the seam wall, so that when the layer is compacted it aligns with the top of the seam wall. The gasket enables uniform compaction of the lane by providing a buttress along the seam against which the asphalt can be compacted.

After the initial lane has been compacted and has cooled, there may be an extended interval before the next lane is paved. During that interval, the ramp extension on the hot joint side of the gasket provides a tire ramp for vehicles to access the initial lane, as is typically required by highway construction codes.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

BRIEF DESCRIPTION OF THE DRAWINGS

FIG. 1 is a perspective view of an asphalt paving seam gasket according to the preferred embodiment of the present invention.

DETAILED DESCRIPTION OF THE PREFERRED EMBODIMENT

Referring to FIG. 1, the preferred embodiment of the present invention is an asphalt paving seam gasket 10, comprising a footing sheet 11, a seam wall 12 and a ramp extension 13. The gasket 10 is preferably made of a water-impermeable rigid plastic material that is resistant to environmental extremes of temperature and humidity and can withstand prolonged exposure to heat, cold, ozone, ultra-violet radiation, and hydrocarbons. The gasket material must also must have high tensile and tear strength and remain rigid under compression and elongation over a broad temperature range. Preferably, in order to increase their adhesiveness and protect them from oxidative and chemical degradation, the contact surfaces of the gasket 10 are coated with an adhesive resin having the same mechanical properties enumerated above. Suitable adhesive resins are epoxy resins and/or silicone resins, as well as silicone-epoxy hybrid polymers and epoxy-modified polysiloxanes. The adhesive-coated contact surfaces are the top and bottom surfaces of the footing sheet 11, the side walls of the seam wall 12, and the slope of the ramp extension 13.

The footing sheet 11 has beveled edges 14 on either side, and on the cold joint side 17 has multiple anchoring means 15, which can be screw sockets or nail holes, for securing the footing 11 to the substrate.

The seam wall 12 has a beveled upper edge 16 on the hot joint side 18. The ramp extension 13 abuts the seam wall 12 on the hot joint side 18 and extends preferably to one-half the height of the seam wall 12. The base of the ramp extension 13 is preferably coextensive with the hot joint side 18 of the ramp extension 13.

As described above, once the gasket 10 is anchored to the substrate, the seam wall 12 provides support for the compaction of the initial lane on the cold joint side 17, while the ramp extension 13 provides sloped vehicular access to the initial lane from the hot joint side 18.

Although the preferred embodiment of the present invention has been disclosed for illustrative purposes, those skilled in the art will appreciate that many additions, modifications and substitutions are possible, without departing from the scope and spirit of the present invention.

What is claimed is:

1. A gasket for use with an asphalt material in sealing a seam between a cold joint of an initial section of asphalt pavement and a hot joint of a subsequent section of asphalt pavement, the gasket integrally comprising:

a vertically oblong seam wall, having the shape of a right-rectangular prism, wherein the seam wall has a vertical seam wall height and a horizontal seam wall thickness, and wherein the seam wall height is approximately equal to a compacted thickness of the initial section of asphalt pavement, and wherein the seam wall has a longitudinal cold joint face, which is oriented toward the cold joint of the initial section of asphalt pavement, and wherein the seam wall has an opposing longitudinal hot joint face, which is oriented toward the hot joint of the subsequent section of asphalt pavement, and wherein the seam wall is adapted and configured to provide support for the cold joint during compaction of the initial section of asphalt pavement;

a ramp extension, having the shape of a right-triangular prism, wherein the ramp extension extends from the hot joint face of the seam wall, and wherein the ramp extension has a ramp incline and a vertical ramp face, which defines a ramp height, and a horizontal ramp base, which defines a ramp length, and wherein the ramp height is less than the seam wall height, and wherein the ramp extension is adapted and configured to serve as a tire ramp for vehicles to access the initial section of asphalt pavement prior to application of the subsequent section of asphalt pavement; and a substantially flat, horizontal footing sheet, having a top surface and a bottom surface, wherein the footing sheet underlies the seam wall and the ramp extension, and wherein the footing sheet has a cold joint wing, which extends beneath the initial section of asphalt pavement, and wherein the footing sheet has a hot joint wing, which extends beneath and is substantially coextensive with the ramp base, and wherein the footing sheet is secured to a substrate below the initial section of asphalt pavement by multiple anchoring means wherein the hot joint face of the seam wall has a top edge which is beveled.

2. The gasket of claim 1, wherein said beveled edge provides a sloped transition configured to facilitate application and compaction of the subsequent section of asphalt pavement.

3. The gasket of claim 2, wherein the cold joint wing and the hot joint wing of the footing sheet each have a beveled leading edge, so as to provide a sloped transition configured to facilitate application of the initial section of asphalt pavement and the subsequent section of asphalt pavement.

4. The gasket of claim 3, wherein the gasket is fabricated from a gasket material, which is a water-impermeable, rigid plastic material that resists deformation and tearing under compressive and shear forces and withstands exposure to heat, cold and hydrocarbons.

5. The gasket of claim 4, wherein one or more contact surfaces of the gasket are coated with an adhesive resin, which is capable of stably adhering to the gasket material and to the asphalt material, and which is water-impermeable and withstands exposure to heat, cold and hydrocarbons, and which prevents penetration of moisture between the gasket and the asphalt material, and which promotes secure adhesion between the gasket and the asphalt material.

6. The gasket of claim 5, wherein the contact surfaces of the gasket consist of the top surface and the bottom surface of the footing sheet, the cold joint face and the hot joint face of the seam wall, and the ramp incline of the ramp extension.

7. The gasket of claim 6, wherein the ramp height is approximately one-half the seam wall height.

* * * * *